US005933989A

United States Patent [19]

Volkert et al.

[11] Patent Number: 5,933,989

[45] Date of Patent: Aug. 10, 1999

[54] POP-UP ITEM WITH EMERGING PANEL

[75] Inventors: Carolyn K. Volkert, Northfield, Ill.; Andrew M. Volkert, Cardiff By The Sea, Calif.

[73] Assignee: Volkert, Inc., Northfield, Ill.

[21] Appl. No.: 08/842,996

[22] Filed: Apr. 25, 1997

[51] Int. Cl.[6] ..... G09F 1/06

[52] U.S. Cl. ..... 40/124.08; 446/148

[58] Field of Search ..... 40/124.01, 124.08, 40/124.09, 124.11, 124.191, 539; 446/148

[56] References Cited

U.S. PATENT DOCUMENTS

| | | | |
|---|---|---|---|
| 895,771 | 8/1908 | Lackner | 446/148 |
| 930,108 | 8/1909 | Walcutt . | |
| 3,995,388 | 12/1976 | Penick et al. | 40/124.08 X |
| 4,963,125 | 10/1990 | Volkert | 493/334 |
| 5,479,732 | 1/1996 | Burtch et al. | 40/124.1 |
| 5,799,424 | 9/1998 | Volkert et al. | 40/124.08 |

*Primary Examiner*—Joanne Silbermann
*Attorney, Agent, or Firm*—Fitch, Even, Tabin & Flannery

[57] ABSTRACT

A pop-up item which includes at least one cover panel that obscures a flattened assembly of intermediate sheet material pieces which upon opening of the cover form a three-dimensional configuration. The construction of the intermediate structure is such that there is relative movement between the tongue panel and at least one display panel which gives the impression that a projection formed in said tongue panel is emerging from behind and protruding outward beyond the free edge of the display panel. In one embodiment, spaced-apart regions of two display panels are adhesively interconnected to form a flange region at the free end thereof so as to create a passageway therebetween in which the projecting leading edge of the tongue panel resides. In another embodiment, flat free edges of facade subpanel portions of two display panels slide along opposite surfaces of a central tongue panel, the free edge of which can be formed to present coupons to a recipient.

20 Claims, 5 Drawing Sheets

FIG. 1
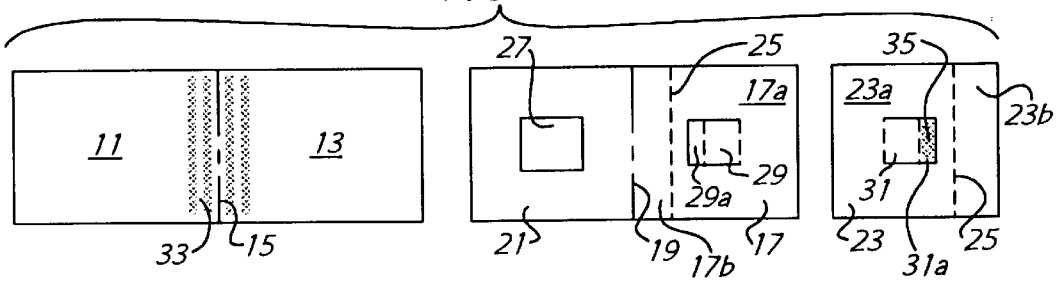
FIG. 2
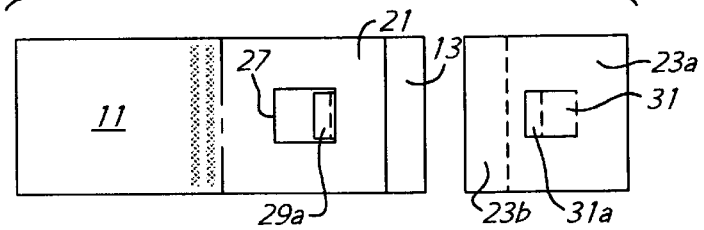
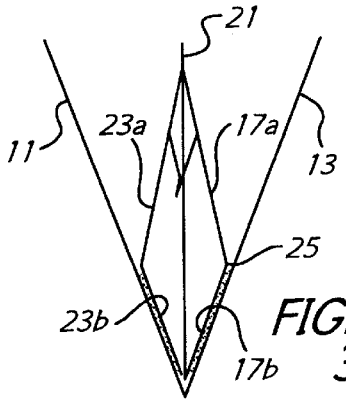
FIG. 3
FIG. 4
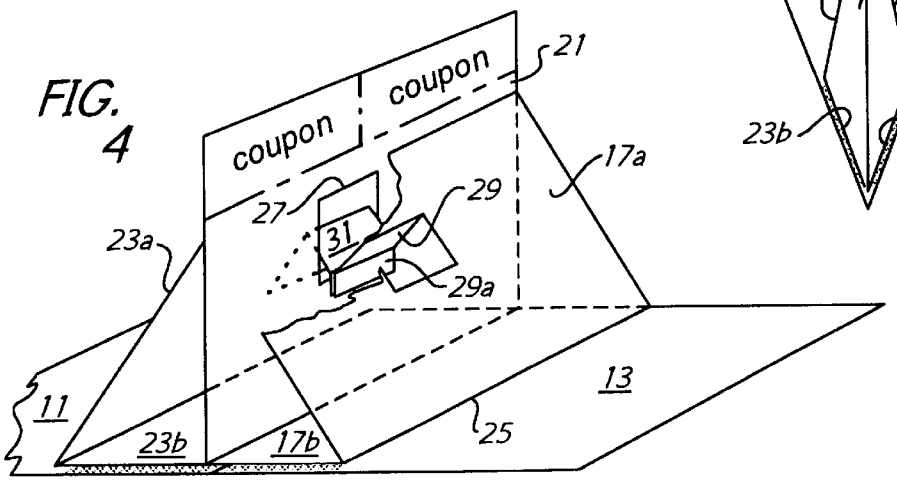
FIG. 5
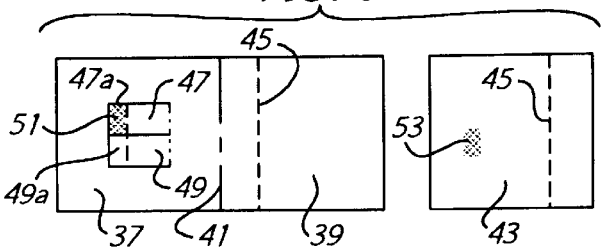
FIG. 6
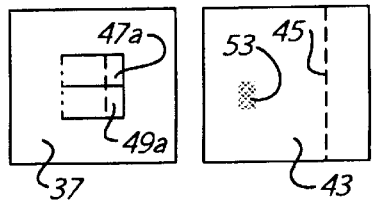

FIG. 7
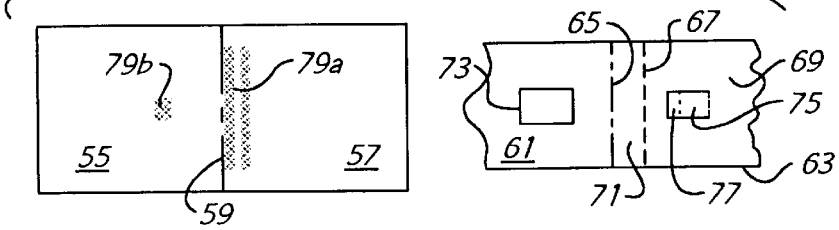
FIG. 8
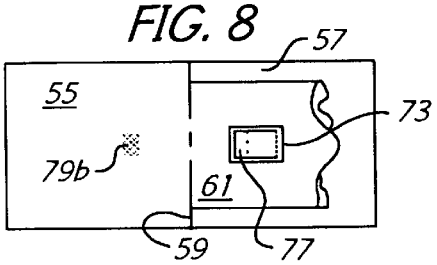
FIG. 9
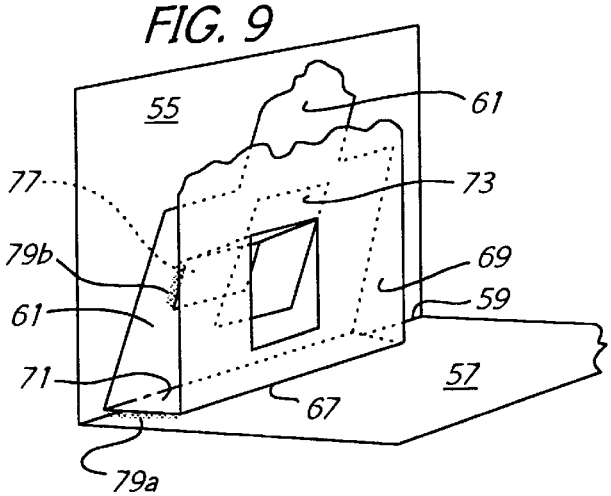
FIG. 10
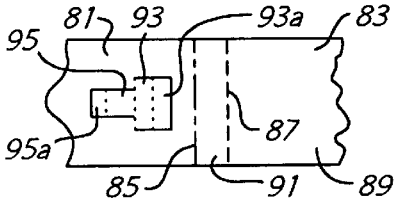
FIG. 11
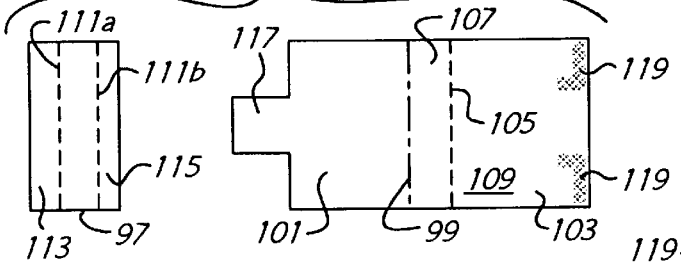
FIG. 12
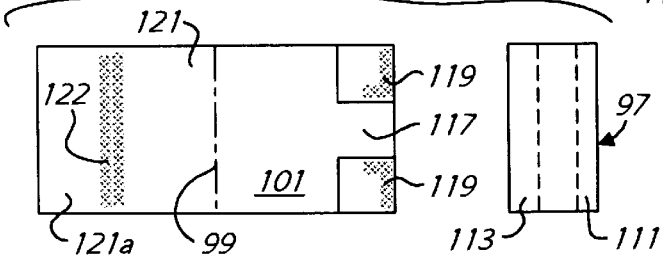
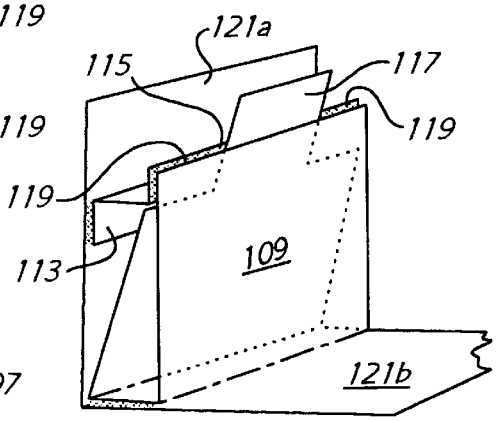
FIG. 13

FIG. 14
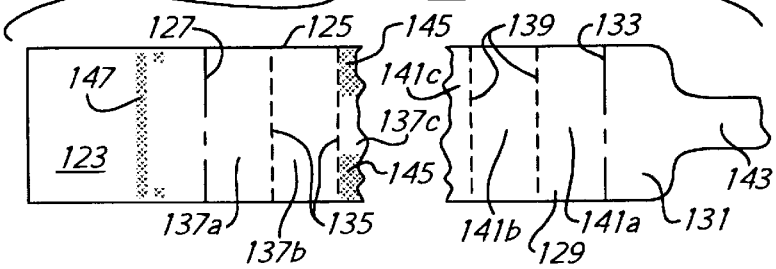
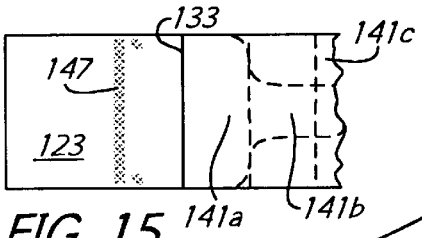
FIG. 15
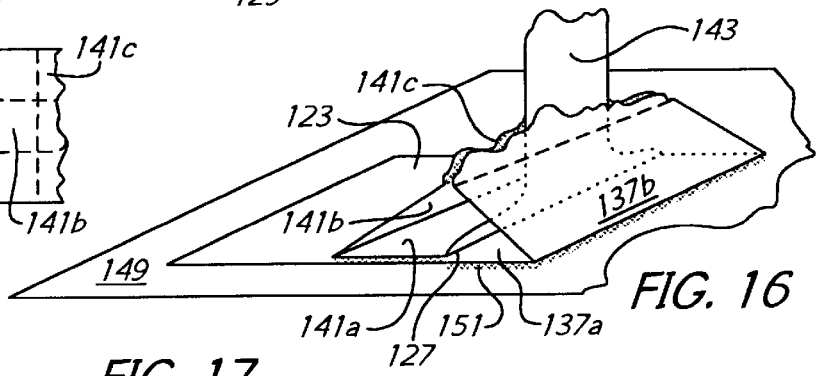
FIG. 16
FIG. 17
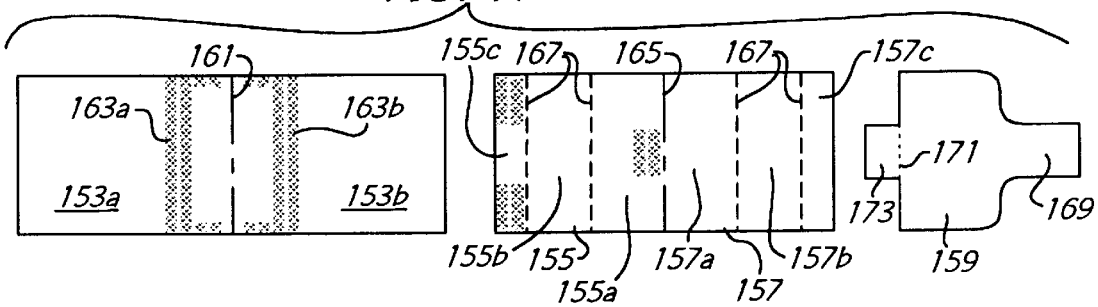
FIG. 18
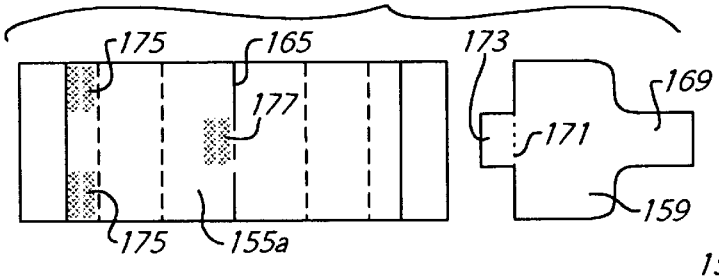
FIG. 19
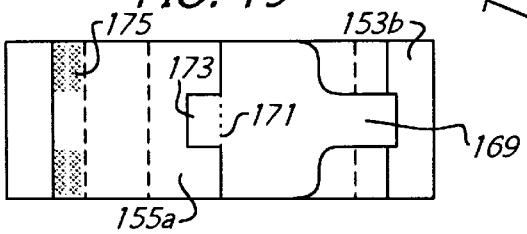
FIG. 20
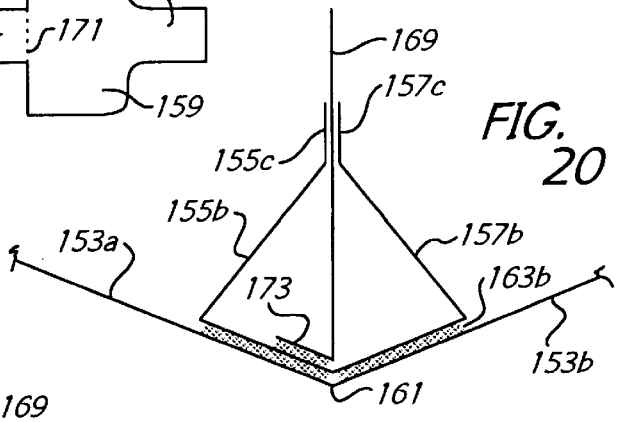

FIG. 25
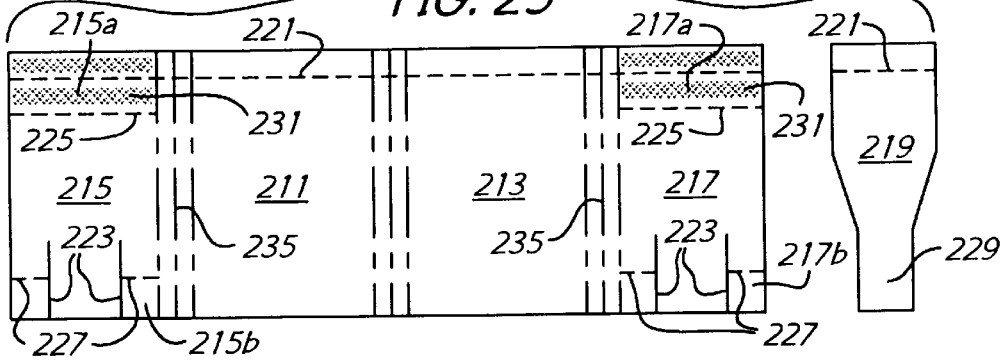
FIG. 26
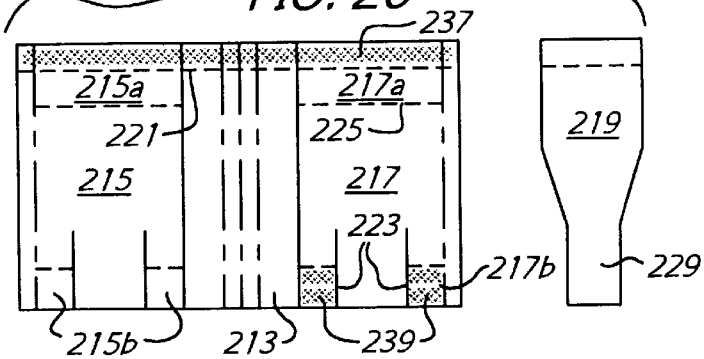
FIG. 28
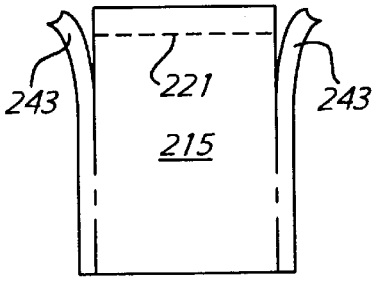
FIG. 27
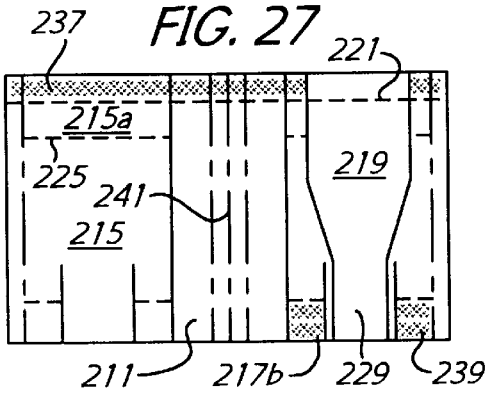
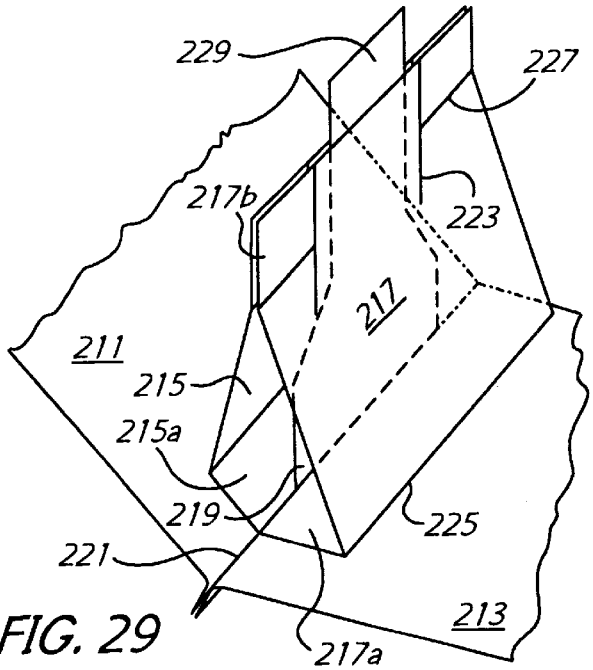
FIG. 29

POP-UP ITEM WITH EMERGING PANEL

This invention relates to printed sheet material pieces and more particularly to dimensional and specialty paper products of a general character wherein an intermediate structure is obscured by one or a pair of cover panels, and which upon opening thereof assumes a three-dimensional configuration wherein the relative movement that occurs gives the impression of one panel emerging from behind another.

BACKGROUND OF THE INVENTION

Advertising handouts, inserts, direct-mail pieces and the like are being used with greater and greater frequency to promote products and/or services. Pop-up items of this general character are frequently used together with an accompanying text in order to illustrate a particular theme or simply to attract attention. Structures of this type may also generate significant attraction to justify their incorporation into greeting cards or the like, which industry constantly seeks novel structures and ideas. Thus, there is a demand for improved, commercially practical items of this general type that incorporate such attention-attracting features, and particularly for such items that are capable of fabrication by mass production, or at least by machine-production, as opposed to hand assembly.

SUMMARY OF THE INVENTION

The invention provides sheet material items wherein a cover obscures a flattened pop-up structure and wherein, upon opening of the cover, an interior panel appears to emerge from the remainder of the overall pop-up structure, as parts of this structure move away from the interior surface of the cover, creating an attention-attracting three-dimensional configuration from which this interior panel now protrudes. Preferably, a pair of covers are provided with a flattened pop-up structure being sandwiched therebetween, and preferably the flattened structure includes a pair of facade panels which obscure a tongue panel that is positioned therebetween. As a result of the relative movement which occurs when one cover is opened, the tongue panel appears to emerge from behind a facade panel, protruding further and further therebeyond in an attention-attracting condition as opening of the cover panel proceeds.

BRIEF DESCRIPTION OF THE DRAWINGS

FIG. 1 is a plan view showing three separate pieces of sheet material that together can be assembled into a pop-up item embodying various features of the present invention.

FIG. 2 is a view similar to FIG. 1 with one of the pieces folded in half and superimposed upon the right-hand portion of the cover panel and with the other piece positioned to be superimposed thereatop.

FIG. 3 is an end view of the fully assembled pop-up item of FIGS. 1 and 2 as the cover is being opened.

FIG. 4 is a perspective view of the item of FIG. 3 shown with the cover completely open and with portions of one of the panels broken away.

FIG. 5 is a plan view showing alternative embodiments of two of the pieces shown in FIG. 1 which can be used to form a flattened subassembly for insertion between a pair of cover panels.

FIG. 6 is a view of the two pieces shown in FIG. 5 after one of them has been folded.

FIG. 7 is a composite view of two sheet material pieces that are designed to form another alternative embodiment of a pop-up item generally similar to that shown in FIGS. 1–4.

FIG. 8 is a view showing the pieces of FIG. 7 with one sheet material piece folded in half and then disposed atop the right-hand panel of the cover, preliminary to the final fabrication step of folding the cover.

FIG. 9 is a perspective view of the completed assembly of FIG. 8 shown with the covers being opened.

FIG. 10 is a plan view of an alternative embodiment of the interior piece shown in FIG. 7.

FIG. 11 is a composite view of two sheet material pieces that, together with a cover, form another alternative embodiment of a pop-up item generally similar to that shown in FIGS. 1 through 4.

FIG. 12 is a view similar to FIG. 11 wherein one of the sheet material pieces has been folded and superimposed upon the right-hand half of a cover panel.

FIG. 13 is a perspective view showing the item of FIGS. 11–12 after fabrication has been completed and the covers are opened.

FIG. 14 is a composite view of two sheet material pieces that together are designed to form a pop-up item generally similar to that shown in FIGS. 11–13.

FIG. 15 is a view of the pieces shown in FIG. 14 after partial assembly has taken place and prior to the final folding of the cover panel.

FIG. 16 is a fragmentary perspective view showing the pop-up item following completion of the fabrication from the pieces of FIGS. 14 and 15 and then affixation to a supporting surface prior to the opening of the cover.

FIG. 17 is a composite view of three sheet material pieces that together form another alternative version of a pop-up item having similarity to that shown in FIGS. 1 through 4.

FIG. 18 is a view of the pieces of FIG. 17 with one piece fixed to the upper surface of the cover and with the other piece moved into position.

FIG. 19 is a view similar to FIG. 18 with the other piece shown superimposed generally upon the right-hand half of the subassembly.

FIG. 20 is an end view of the fabricated pop-up item shown with the cover panels approaching full open position.

FIG. 25 is a view similar to FIG. 21 showing an alternative embodiment of a blank that might be fashioned from a continuous web of sheet material and then cut and manipulated to form a pop-up item similar to that shown in FIGS. 1–4 but having a false backbone.

FIG. 26 is a view similar to FIG. 25 showing the blank of FIG. 25 after it has been manipulated so that two interior panels have been superimposed upon two cover panels.

FIG. 27 is a similar view which shows the superimposition of a tongue panel, which may have been earlier severed from the web, atop one of the cover panel subassemblies.

FIG. 28 shows the fully folded blank being trimmed along both side edges to create the operative pop-up item.

FIG. 29 shows the final fabricated pop-up item created from the pieces of FIGS. 25–28 to have a false backbone, with the covers shown in a partly open position.

DETAILED DESCRIPTION OF THE PREFERRED EMBODIMENTS

Figure 21:
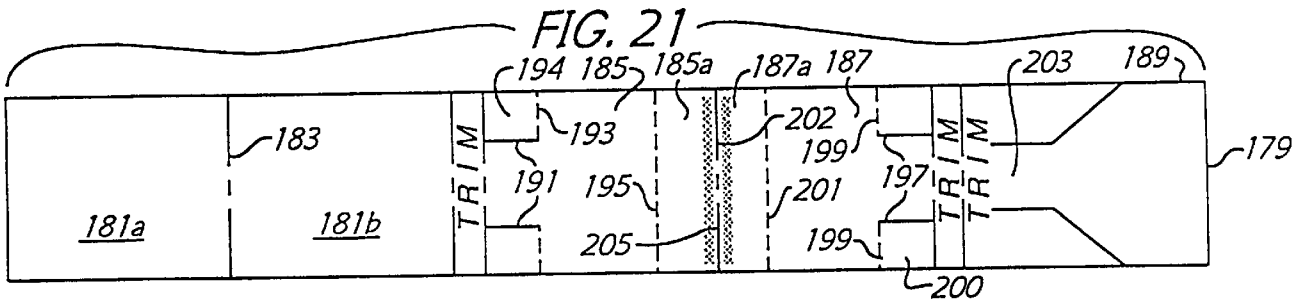
FIG. 21 is a plan view of a single blank section of a continuous web designed to be formed into a pair of covers and a three-panel intermediate structure for fabrication into a pop-up item generally similar to that shown in FIGS. 1–4.

Illustrated in FIG. 1 are three separate sheet material pieces which can be assembled to form a three-dimensional pop-up item, as shown in FIG. 4, embodying various features of the present invention. More specifically, the left-hand piece comprises first and second cover panels 11, 13 which are separated from each other along a straight line 15 about which folding ultimately occurs. The remaining two pieces together form an intermediate pop-up structure which is sandwiched between the cover panels 11 and 13 in the ultimate assembly.

More particularly, the central piece includes a first display panel 17 that is separated along a straight line 19 from a tongue panel 21. The remaining piece constitutes a second display panel 23. Each of the display panels has formed therein a vertical line of weakness 25 which divides that display panel into a facade subpanel 17*a*, 23*a* and a base subpanel 17*b*, 23*b*.

Die-cut in the center of the tongue panel 21 is a rectangular aperture 27, and die-cut centrally in the facade subpanels 17*a* and 23*a* are a pair of tabs 29, 31. Each tab is formed with a tab subpanel 29*a*, 31*a* adjacent its free edge, with its opposite edge being hinged to the remainder of the facade panel. A central adhesive pattern 33 straddling the fold-line 15 is applied to the surface of the pair of cover panels. A smaller adhesive pattern 35 is applied to the tab subpanel 31*a*.

The sheet material is preferably suitable paper or paperweight material, glossy or matte finished as desired; however, it could alternatively be any suitable fabricated sheet material, e.g. thermoplastic material. The adhesive material can also be any suitable adhesive material, for example, hot melt or solvent-based adhesive. Generally, any permanent-type adhesive can be used which has a bond strength that is generally higher than the tear strength of the fibers when a paperboard sheet material is used. Other adhesive arrangements as are well known in the art may alternatively be employed; for example, heat, ultrasonic or RF-activated or even micro-encapsulated adhesives can alternatively be used. In all of the embodiments herein shown, instead of applying the adhesive to the particular surface as illustrated, the adhesive could instead be applied to the facing location on the other sheet material piece that will be joined thereto. Moreover, if desired, one may also use co-adhesive patterns of a material which will adhere only to itself; such would be applied to appropriate locations on facing surfaces, as also well known in this art.

In the assembly operation, the central piece is first manipulated by folding the two-panel interior piece about the central line of demarcation 19 so that the tongue panel 21 becomes superimposed upon the first display panel 17. Then the folded piece is placed upon the cover panel 13 as shown in FIG. 2, with the exterior-facing surface of the base subpanel 17*b* in alignment with the right-hand portion of the adhesive pattern 33. After the folding is complete, the tab 29*a* is aligned within the aperture 27 as shown in FIG. 2. FIG. 2 also depicts the second display panel 23 having been rotated 180° about its left-hand edge so that the base subpanel 23*b* is now disposed to the left of the facade subpanel 23*a*, in which alignment it will next be superimposed atop the tongue panel 21 to complete the intermediate flattened structure. Alternatively, the adhesive pattern 35 could instead be applied to the tab subpanel 29*a*, and the third panel 23 could be originally oriented (as a part of a web if desired) as depicted in FIG. 2 so it could be simply displaced laterally without rotating. As a result of this final superimposition, the adhesive pattern 35 connects the tab subpanel 31*a* to the tab subpanel 29*a*. The final step of the assembly is the folding of the cover panel 11 about the line of demarcation 15 to sandwich the three panel subassembly therebetween, which causes affixation of the exterior-facing surface of the base subpanel 23*b* to the interior surface of the cover 11 by means of the left-hand half of the adhesive pattern 33.

When the cover panels 11 and 13 of the completed assembly are then opened, the tongue panel 21, which has its trailing edge along the fold line 19 in juxtaposition with the fold-line 15, remains relatively stationary. The adhesive connections between the interior surfaces of the cover panels 11 and 13 and the base subpanels causes each of these subpanels to pivot outward with the respective cover (as shown in FIG. 3) causing the lower edges of the facade subpanels 17*a* and 23*a* to move with them. However, because upper regions of the facade panels are interconnected with each other through the tabs 29, 31 via their adhesively joined hinged subpanels 29*a*, 31*a* (which generally lie and move in the region of the rectangular aperture 27), the free edges of the facade panels remain aligned generally along the centerline plane, as shown in FIG. 3, when bending occurs along the lines of weakness 25. The opening movement continues until the full open configuration is reached as depicted in FIG. 4, and during this movement, the free edges of the facade subpanels 23*a* and 17*a* slide slowly downward along the opposite surfaces of the tongue panel 21 as a result of the interconnection between the tabs 29*a* and 31*a* which are hinged together and pass through the rectangular aperture 27.

In the flattened condition, the tongue panel 21 is completely obscured behind the facade subpanels 17*a* and 23*a*. Upon opening, the leading edge of the tongue panel 21 appears to be emerging past the free edges of the two facade subpanels in an attention-attracting orientation, and it protrudes further and further therepast as the cover panels pivot to the full open position. If desired for use in direct mail advertising or the like, two or more coupons may be optionally formed along the free edge of the tongue panel 21 above the aperture 27, as depicted in broken lines in FIG. 4.

Depicted in FIGS. 5 and 6 is an alternative embodiment of a pair of pieces for forming a flattened interior subassembly similar to that illustrated in FIG. 1; however, a pair of interconnecting tabs are instead formed in the tongue panel and respectively adhesively connected to an interior surface of each facade panel. More specifically, there is shown a tongue panel 37 that is formed as half of one piece, separated from a first display panel 39 along a fold-line 41; a separate, imperforate second display panel 43 is provided. Both of the display panels have formed therein lines of weakness 45 which divide the display panels into base subpanels and facade subpanels as previously described. Die-cut centrally within the tongue panel are side-by-side tabs 47 and 49 which are each hinged along one edge to the remainder of the tongue panel and which have hinged subpanels 47*a* and 49*a* at their other edge. An adhesive pattern 51 is applied to the subpanel 47*a*, and an adhesive pattern 53 is applied to the facade panel portion of the panel 43 which is aligned with the tab subpanel 49*a* in the ultimate assembly.

As one step in the fabrication, the tongue panel 37 is folded along the line 41 so as to be superimposed upon the first display panel 39, as generally depicted in FIG. 6. As a result, the tab 47*a* becomes affixed to the interior surface of the facade panel portion of the display panel 39 through the adhesive pattern 51. As the next step in the fabrication, the right-hand single display panel 43 is rotated 180° about its left-hand edge and superimposed atop the tongue panel, as a result of which the adhesive pattern 53 affixes the tab subpanel 49*a* to the interior surface of the display panel 43.

This three panel subassembly is then sandwiched between a pair of cover panels, such as the cover panels 11 and 13, which carry an adhesive pattern that causes interconnection of the base subpanels of both display panels 39 and 43 to the covers, creating a flattened pop-up assembly generally similar to that shown in FIGS. 1–4. Opening of the cover panels causes a similar effect to be achieved because the interconnection between the tabs and the interior surface of the respective facade subpanel portions of the display panels, which results in bending of both along the lines of weakness 45, causes the free edges of the display panels to slide slowly down the opposite surfaces of the tongue panel toward the hinge line about which the cover panels are being pivoted to the open position.

As another alternative, it should be understood that other types of tab arrangements may be employed wherein one central tab is flanked by a pair of tabs of lesser width, with the central tab being affixed to one display panel and with both of the flanking tabs being adhesively affixed to the other display panel. As a further alternative, the tabs 47 and 49 could instead be respectively formed in the facade subpanels of the display panels 39, 43, with the tab subpanels then being adhesively affixed to opposite surfaces of an unapertured central tongue panel.

Illustrated in FIG. 7 are two sheet material pieces which are designed to form another alternative embodiment of a pop-up item generally similar to that illustrated in FIG. 4. The left-hand piece includes front and rear cover panels 55 and 57 which are separated along a vertical centerline 59 upon which folding will eventually occur. The right-hand piece includes a tongue panel 61 and a display panel 63 which are separated by a line of demarcation 65 upon which folding also occurs. The display panel 63 is divided by a line of weakness 67 into a facade subpanel 69 and a base subpanel 71. A rectangular aperture 73 is die-cut in the tongue panel 61, and a tab member 75 is die-cut in the facade subpanel 69. The tab member is hinged along its right-hand edge to the remainder of the facade subpanel and has a line of weakness which creates a tab subpanel 77 at its left-hand edge.

A spaced-apart adhesive pattern 79 is applied to the surface of the cover piece. The larger portion 79*a* is located just to the right of the fold-line 59 and is sized proportionately to the size of the base subpanel 71; whereas a smaller adhesive pattern 79*b* having the proximate size of the tab subpanel 77 is applied to the left-hand cover panel 55. As a step in the fabrication, the tongue panel 61 is folded along the line 65 so as to be superimposed atop the display panel 63, and this folded piece is then located atop the right-hand cover panel 57 as shown in FIG. 8. Because the rectangular aperture 73 is proportioned to be larger than the tab member 75, the tab member resides centrally therein in the folded condition, with the base subpanel 71 becoming secured to the cover panel 57 through the adhesive pattern 79*a*. When the final folding of the cover occurs along the line 59, the tab subpanel 77 becomes affixed to the cover panel 55 via the adhesive pattern 79*b*.

When the covers 55 and 57 are pivoted open along the fold-line 59, as shown in FIG. 9, the interconnection of the tab subpanel 77 to the cover panel 55 causes the facade subpanel 69 to pivot along the line of weakness 67 away from the other cover panel 57 and create a three-dimensional display. The tab member 75 does not interfere with the tongue panel 61 because it passes through the oversized rectangular aperture 73 which affords adequate clearance. As a result, the upper edge of the facade subpanel 69 slides against the facing surface of the tongue panel 61, giving the impression that the upper end of the tongue panel 61 is emerging from behind the facade subpanel in an attention-attracting configuration.

Depicted in FIG. 10 is an alternative embodiment of the right-hand piece that is shown in FIG. 7. It includes a tongue panel 81 and a display panel 83 separated by a fold-line 85. A line of weakness 87 in the display panel divides it into a facade subpanel 89 and a base subpanel 91. Die-cut in the tongue panel 81 are a pair of tab members, a wide tab member 93 and a narrow tab member 95. The wide tab member 93 is hinged along its left-hand edge to the remainder of the tongue panel 81 and has a subpanel 93*a* formed at its right-hand edge. The narrow tab member 95 is hinged along its right-hand edge to the wide tab member 93 and has a tab subpanel 95*a* formed along its left-hand edge.

Adhesive is applied either to the subpanel 95*a* or to the corresponding location on the facade subpanel 89. Thereafter, folding of the piece along the line 85 so as to superimpose the tongue panel upon the display panel, interconnects the subpanel 95*a* of the smaller tab with the facade subpanel 89. Thereafter, the folded piece is superimposed upon one of a pair of cover panels like the panels 55 and 57 so that one of the cover panels becomes affixed to the base subpanel 91, and the ultimate folding of the other cover panel, which carries adhesive like the pattern 79*b*, secures the wider tab subpanel 93*a* to the other cover panel. Accordingly, when the cover panels are opened, the interconnection of the imperforate facade subpanel 89 to the opposite cover panel via the two tabs 93*a* and 95*a* causes a three-dimensional structure similar to that shown in FIG. 9 to be created.

Depicted in FIG. 11 are two sheet material pieces that are designed to form a flattened interior structure between a pair of cover panels for fabrication into still another alternative embodiment of a pop-up item. More specifically, there are included a rear narrow display panel 97 and a larger sheet that is divided by a fold-line 99 into a tongue panel 101 and a front display panel 103. A line of weakness 105 in the front display panel divides it into a base subpanel 107 and a facade subpanel 109. The rear display panel 97 is formed with a pair of lines of weakness 111*a* and 111*b* which create a base subpanel 113 and a flange subpanel 115.

The tongue panel 101 is formed with a central projection 117, and a pair of adhesive patterns 119 are applied to the facade subpanel 109 in regions generally in flanking alignment with this central projection. When the larger piece is folded along the fold-line 99 so that the tongue panel 101 is superimposed atop the display panel 103, the projection 117 lies in a central region between the adhesive patterns 119, as shown in FIG. 12. It is superimposed in this orientation atop the right-hand half of a cover 121 like that shown in FIG. 7 which carries an adhesive pattern just to the right of its centerline to affix the base subpanel 107 thereto. The left-hand cover panel 121*a* carries an adhesive pattern 122 which is proportioned and positioned to be aligned with the base subpanel 113 of the rear display panel 97. The rear display panel 97 is next superimposed atop the folded subassembly so that the adhesive patterns 119 attach the flange subpanel 111 to the facade subpanel 109 at two spaced-apart regions, leaving a passageway in the form of a closely constraining chute therebetween in which the projection 117 resides and in which there will be closely defined relative travel. As the final step in the fabrication, folding of the cover panel 121*a* about the centerline sandwiches the flattened subassembly therebetween, and the adhesive pattern 122 carried by the rear cover affixes the base subpanel 113 of the narrow display panel 97 thereto. In this flattened subassembly, at least the leading edge of the projection 117 resides in this chute.

When the covers 121*a* and 121*b* are opened, as depicted in FIG. 13, the facade subpanel 109 assumes a three-dimensional orientation generally parallel to the rear cover panel 121*a*. During the opening, the facade subpanel 109 and the interconnected flange subpanel 115 slide along the opposite surfaces of the projection 117, giving the impression that the projection is emerging from behind the facade subpanel 109 and protruding ever further outward beyond the free edge thereof. This well-constrained relative movement occurs in the chute of the passageway between the spaced apart adhesive patterns 119 in which wherein the projection is restrained.

Illustrated in FIG. 14 is still another embodiment of two sheet material pieces which are designed to form a pop-up item generally similar to that shown in FIG. 13. The left-hand piece includes a cover panel 123 connected to a front display panel along a fold-line 127. The right-hand piece includes a rear display panel 129 connected to a tongue panel 131 along a fold-line 133. The front display panel is formed with a pair of lines of weakness 135 which respectively create a base subpanel 137*a*, a facade subpanel 137*b* and a flange subpanel 137*c*. The rear display panel is similar formed with a pair of lines of weakness 139 which similarly create a base subpanel 141*a*, a facade subpanel 141*b* and a flange subpanel 141*c*. The tongue panel 131 is formed with a central projection 143. The free edges of the flange subpanels 137*c* and 141*c* and the free edge of the projection 143 are preferably formed with matching carved or curved contours, as best seen in FIG. 15. Adhesive patterns 145 are applied at opposite edge regions of the flange subpanel 137*c*, and an adhesive pattern 147 is applied to the interior surface of the cover panel 123.

The right-hand piece is folded along the fold-line 133 so that the rear display panel is superimposed atop the tongue panel 131, and in this form it is in turn superimposed atop the right-hand portion of the other piece which constitutes the front display panel, with the fold-line 133 being aligned with the centerline 127 which lies at the right-hand edge of the cover panel, as shown in FIG. 15. As a result of this step, the adhesive patterns 145 interconnect the two flange subpanels 141*c* and 137*c* at regions which flank the central projection 143 and leave a passageway therebetween in which the leading edge portion of the projection resides. As the final step of fabrication, the cover panel 123 is folded along the line 127 so as to be superimposed atop the folded subassembly, as a result of which the adhesive pattern 147 interconnects the base subpanel 141*a* and the interior surface of the cover panel 123.

The resultant flattened assembly is designed to be affixed to a supporting surface, such as the horizontal surface 149 shown in FIG. 16, which, for example, could be the cover to a container, such as a fast-food container. Alternatively, it could be affixed to one page between the facing pages in a magazine or the like. The affixation is preferably via an adhesive pattern 151 that is applied either to the base subpanel 137*a* or to the supporting surface 149. With the base subpanel 137*a* so affixed, pivoting of the cover panel 123 along the fold-line 127 causes the interconnected flange subpanels 137*c* and 141*c* to slide along the opposite surfaces of the projection 143 as they are drawn toward the fold-line 127 as opening proceeds. As a result, the projection 143 gives the appearance of protruding further and further outward from the three-dimensional structure which is formed by the facade panels 137*b* and 141*b* in an attention-attracting configuration.

Illustrated in FIG. 17 are three separate sheet material pieces comprising a pair of cover panels 153*a* and 153*b*, a pair of display panels 155 and 157 and a tongue panel 159; together they are designed to be fabricated into yet another embodiment of a pop-up item. The cover panels are separated by a vertical fold-line 161 and have applied thereto a pair of adhesive patterns 163*a* and 163*b*. The display panels are separated by a vertical fold-line 165, and each of them includes a pair of lines of weakness 167. The left-hand display panel 155 is divided into a base subpanel 155*a*, a facade subpanel 155*b* and a flange subpanel 155*c*; the right-hand display panel 157 is similarly divided into a base subpanel 157*a*, a facade subpanel 157*b* and a flange subpanel 157*c*. The tongue panel 159 is formed with a central projection 169 and with a line of weakness 171 that creates a hinged, central tab subpanel 173. The central sheet material piece, comprising the display panels 155 and 157, is first superimposed atop the cover panels with the fold-lines 161 and 165 aligned with each other, as shown in FIG. 18, as a result of which the base subpanels 155*a* and 157*a* become affixed to the covers 153*a* and 153*b* by adhesive patterns 163*a* and 163*b* that flank the lines of weakness 167.

Either earlier as depicted or at this time, an adhesive pattern 175 is applied to one of the flange subpanels at spaced apart locations, and an adhesive pattern 177 is applied to a central location on the base subpanel 155*a* near the fold-line 165 where it will be in alignment with the tab subpanel 173 of the tongue panel. The tongue panel 159 is then superimposed atop the two-piece subassembly, with the line of weakness 171 aligned with the central fold-line 165 so that the adhesive pattern 177 affixes the tab subpanel 173 to the base subpanel 155*a*. If desired, the tongue panel 159 could be slightly reproportioned, and the tab 173 aligned with its free edge along the fold line 165 although such would slightly shorten the extent of protrusion if no other changes were made. As the final step in the fabrication, the assembly is folded along the fold-lines 161, 165 and 171 so as to sandwich the flattened intermediate subassembly between the covers 153*a* and 153*b*. As a result of this step, the adhesive patterns 175 interconnect the two flange subpanels 155*c* and 157*c* at spaced apart locations flanking the projection 169, creating a closely confining passageway having the form of a flat tube in which a section of the projection resides.

Thereafter, when the cover panels 153*a* and 153*b* are opened as shown in FIG. 20, the adhesive patterns 163*a* and 163*b* cause the base subpanels to move therewith, causing the flange subpanels 155*c*, 157*c* to move toward the fold-line 161 so that the passageway formed between them by the spaced-apart adhesive patterns 175 slides downward along the opposite surfaces of the projection 169. As a result, the projection 169 gives the appearance of emerging between the display panels and protruding further and further beyond the free edges thereof in attention-attracting orientation.

Illustrated in FIG. 21 is a single blank 179 which can simply be a singular piece or can be a section in a continuous web that would be used to mass produce a particular pop-up item. From left to right, the blank includes cover panels 181*a* and 181*b* separated by a fold line 183, a left display panel 185, a right display panel 187 and a tongue panel 189; the last three panels include trim sections that are so indicated. The left-hand display panel contains a pair of slits 191 located interior of a pair of short lines of weakness 193 that define flange subpanels 194 and contains a line of weakness 195 that defines a base subpanel 185*a*. Similar slits 197 and lines of weakness 199 and 201 are formed in the right-hand display panel 187; they form flange subpanels 200 and a base subpanel 187*a*. The display panels 185, 187 are separated along a fold-line 202. The tongue panel 189 is die-cut to provide a central narrower projection 203. The flanking die-cut portions can be removed at this time or can be left to be removed at the time of the trimming as described hereinafter.

Figure 22:
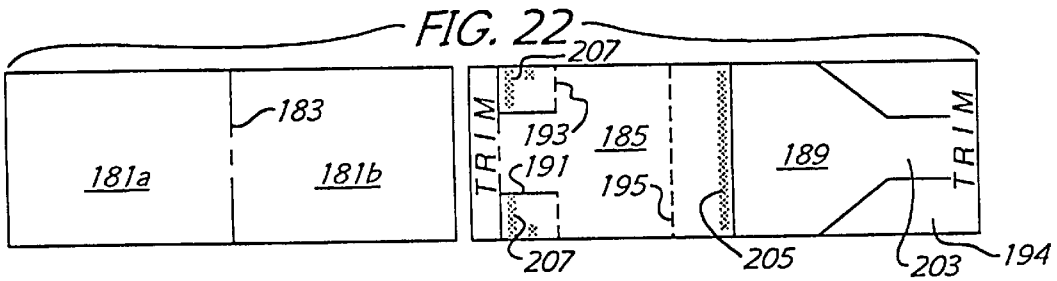
FIG. 22 is a view similar to FIG. 21 showing this one blank of the web after it has been severed along one edge of the cover and after a first folding step has occurred.
Figure 23:
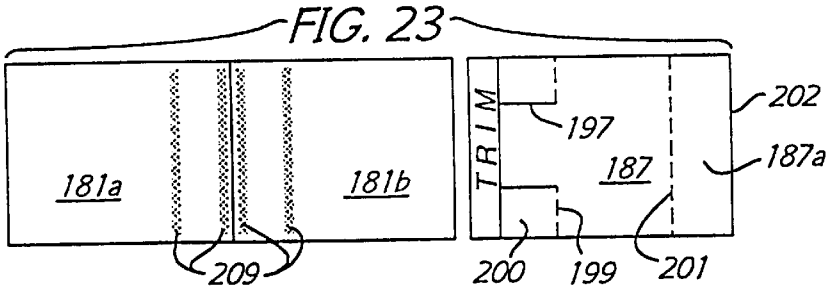
FIG. 23 is a view similar to FIG. 22 showing the blank after a second folding step has occurred.

As shown in FIG. 22, the cover panels 181*a* and 181*b* are severed from the remainder of the web, and the tongue panel 189 is folded so as to be superimposed atop the right-hand display panel 187. As a result of an adhesive pattern 205, which is applied to the web 179 so that it flanks the line of demarcation 202 between the adjacent display panels 185, 187, the base edge of the tongue panel becomes affixed to the base subpanel 187*a* along this narrow edge region. Either now or earlier, an adhesive pattern 207 is applied to one pair of the flange subpanels, e.g. the subpanels 194. A second folding step then takes place so that the tongue panel 189 and the right-hand display panel 187 are superimposed atop the left-hand display panel 185, as depicted in FIG. 23. As a result of this folding step, a narrow interconnection is created between the base subpanel 185*a* and the base edge of the tongue panel 189 via the other half of the adhesive pattern 205, and the flange subpanels 194, 200 also become interconnected at regions laterally outside of the slits 191 and 197 as a result of the adhesive patterns 207.

A trimming operation then takes place so as to remove the left-hand portion, marked "TRIM", of the now twice-folded section of the web, thus freeing the left-hand edge of the projection 203. Either at this time or earlier, an adhesive pattern 209 is applied to the cover panels 181*a* and 181*b* in the regions flanking the fold-line 183, which can be in the form of four strips as depicted or can completely cover the region if desired. Following the trimming operation, the folded subassembly is superimposed atop one of the cover panels with the fold-line 202 aligned with the fold-line 183 so that one of the base subpanels becomes affixed to the juxtaposed cover surface by the adhesive pattern 209. Thereafter, folding of the cover panel about the fold-line 183 completes the fabrication assembly. Moreover, as seen in FIG. 24, adhesive patterns 205 and 209 create a short false backbone 210 which defines the straight hinge line along which the two covers pivot.

Figure 24:
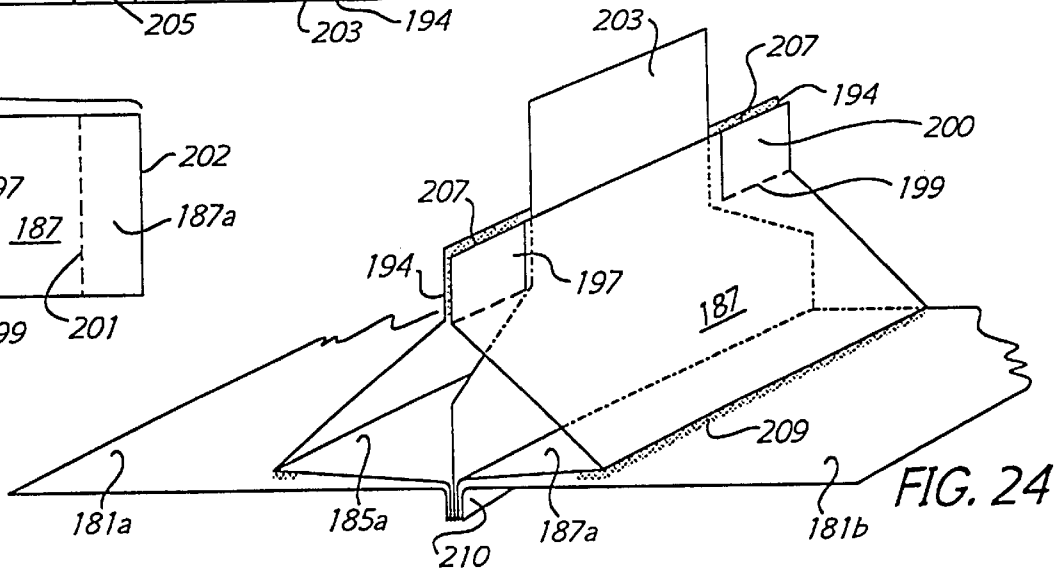
FIG. 24 is a perspective view showing the final fabricated pop-up item after superimposition of the folded blank portion onto the cover portion and trimming, with the cover panels fully opened.

When the covers are opened as illustrated in FIG. 24, the base subpanels 185*a* and 187*a* move with the covers 181*a* and 181*b* as a result of the adhesive pattern 209. The base edge of the tongue panel is secured, as a part of the false backbone, to facing edges of the panels between which it is sandwiched. As in the previously described constructions, the surface-to-surface interconnected flange subpanels 194, 200 at the free edges of the display panels 187 move toward the false backbone as the opening proceeds, causing the projection 203 of the tongue panel to extend further and further therebeyond. The presence of the slits 197 reduces any friction between the facing surfaces and allows the relative movement to occur smoothly. As in the previous arrangements, the impression is one of the tongue projection 203 emerging from behind the display panels and projecting further and further beyond the free edges thereof.

Illustrated in FIG. 25 is an alternative embodiment of sheet material designed for the construction of a pop-up item generally similar to that shown in FIG. 24. Illustrated are two pieces of sheet material, which can be part of the same web or which can be from separate web material. The larger piece includes a pair of cover panels 211 and 213 that are flanked by a pair of display panels 215 and 217. The separate piece constitutes a tongue panel 219. Both of the pieces of material are formed with a horizontal line of weakness 221 extending thereacross which provides a false backbone in the ultimate assembly. Each of the display panels 215, 217 is formed with a pair of spaced-apart vertical slits 223 which serve a function similar to the slits 191, 197 in the embodiment depicted in FIGS. 21–24. Each display panel is also provided with two lines of weakness 225, 227 which are parallel to the line of weakness 221 and thus extend horizontally in FIG. 25. The lines of weakness 225 define a base subpanel 215*a*, 217*a* in the respective display panels, and the lines of weakness 227 are interrupted, lying in the regions laterally outward of the slits 223, and form flange subpanels 215*b*, 217*b*. The tongue panel 219 is formed with a projection 229 having a width slightly less than the distance between the pairs of spaced apart slits 223.

An adhesive pattern may be applied extending completely across the piece above the line of weakness 221 to eventually form the false backbone, or adhesive patterns 231 may only be applied in the regions of the display panels 215, 217 lying above the lines of weakness 225 as depicted in FIG. 25 (or such may alternatively be applied to the corresponding locations on the cover panels). A first folding step takes place where the display panels 215, 217 are folded along lines of demarcation 235 so as to lie respectively atop the cover panels 211, 213. The adhesive patterns 231 effect adhesive attachment in the region of the false backbone and affix the base subpanels 215a, 217a to the cover panels 211, 213, respectively. The folded configuration is depicted in FIG. 26, and additional adhesive patterns are then applied. An adhesive pattern 237 is applied across the entire upper edge of the folded blank in the region above the line of weakness 221, and adhesive patterns 239 are applied in the regions of one set of flange subpanels, such as the subpanels 217*b*.

Next, as depicted in FIG. 27, the tongue panel 219 is superimposed atop the display panel 217 (or the display panel 215), and it becomes affixed in this position in the region of the false backbone via the adhesive pattern 237. With the tongue panel 219 in place, the once-folded assembly is once again folded about the line of demarcation 241 to sandwich the two display panels and the tongue panel between the cover panels 211, 213. Once the final folding step has been accomplished, both lateral edges are trimmed as shown in FIG. 28 so as to remove lateral edge regions 243, as a result of which the only interconnections between the cover panels 211, 213 and the display panels 215, 217 are via the adhesive connections.

Opening of the cover panels 211, 213 causes pivoting along the lines of weakness 221 which forms the false backbone as depicted in FIG. 29. The adhesive interconnections between the base subpanels 215*a*, 217*a* via the adhesive pattern 231 causes these two subpanels to move with the cover panels creating the three-dimensional configuration as a result of the interconnection between the respective flange subpanels via the adhesive patterns 239. The base edge of the tongue panel 219 is secured as a part of the false backbone by the adhesive pattern 237, and its projection portion 229 resides in the passageway region provided between the spaced apart flange subpanels 215*b*, 217*b*. As a result, when the free edges of the flange subpanels move toward the hinge line 221 as a result of the adhesive interconnections, the tongue panel 219 remains relatively stationary and appears to emerge from the region therebetween, where it was originally obscured, so as to protrude further and further therepast. The provision of the slits 223 allows the free edges of the display panel to slide easily against the outer surfaces of the tongue panel by reducing the effects of friction in these areas. Thus, as can be seen in FIGS. 25 through 29, there is provided a pop-up item that can be efficiently formed as a part of a continuous web with the tongue panel being either a part of that web that is initially severed, or being fashioned from separate sheet material of perhaps slightly stiffer stock. The resultant construction provides attention-attracting three-dimensional movement, and if desired, the end of the projection 229 of the tongue panel could be fashioned as a detachable coupon.

Although the invention has been described with regard to certain preferred embodiments, it should be understood that various changes and modifications as would be obvious to one having the ordinary skill in this art may be made without departing from the scope of the invention which is set forth in the claims appended hereto. For example, although many of the embodiments are shown as constituting separate pieces, it should be understood that they could be fashioned from a continuous web of sheet material that has been printed or otherwise suitably designed so as to constitute a series of rectangular blanks, each in the form of a group of panel arrangements designed to form single pop-up items of generally structurally identical construction, which could however be printed with different designs or die-cut in slightly different fashion if desired. Although such fabrication from a continuous web or roll is often preferred for mass production, cut sheets containing multiple pop-up item blanks can have advantages in certain cases. Instead of die-cutting one blank at a time, in such a cut sheet, two or more blanks might be die-cut as a group, which would allow for the creation of pop-up elements of different shapes within the same cut sheet. In such a case, the pop-up items which result might have a different appearance but would be structurally identical in that the fold lines would be in precisely the same locations. Although the preferred embodiments are illustrated, it should be understood that adhesive patterns may be alternatively applied to corresponding surface portions of the web from those illustrated prior to folding wherein surface-to-surface contact subsequently is achieved.

Particular features of the invention are emphasized in the claims that follow.

What is claimed is:

1. A pop-up item which comprises a pair of cover panels which are hinged together along a straight hinge line so as to permit pivoting to an open configuration, said cover panels each having an interior surface and an exterior surface first and second panels disposed interior of said cover panels and sandwiched therebetween, each of said first and second panels having a free edge, an edge generally opposite said free edge, a pair of lateral edges, and interior- and exterior-facing surfaces, means connecting regions of said interior-facing surface of said first panel in surface-to-surface contact with said interior-facing surface of said second panel at spaced apart locations generally adjacent said lateral edges so as to create a central passageway therebetween in the region between said spaced-apart connections, at least one of said first and second panels having a pair of parallel slit means which extend from said free edge thereof toward said opposite edge thereof at a location adjacent said central passageway, flat tongue means having a leading edge and a trailing edge, which is disposed in said central passageway between said first and second panels, and means adhesively interconnecting said interior surfaces of said cover panels respectively to said exterior-facing surfaces of said first and second panels, said tongue means having such a length that, when said cover panels are pivoted away from each other about said hinge line, a three-dimensional configuration is created wherein said regions of said first and second panels which are connected in surface-to-surface contact to each other are caused to move toward said hinge line, sliding relative to said tongue means, so that said leading edge thereof protrudes beyond said free edges of said first and second panels in attention-attracting orientation.

2. An item according to claim 1 wherein said first and second panels include base subpanels formed near said opposite edges thereof the exterior surfaces of which are adhesively joined to said cover panels.

3. An item according to claim 1 wherein said trailing edge of said tongue means is hinged to the opposite edge of one of said first and second panels.

4. An item according to claim 1 wherein said means connecting said first and second panels comprises adhesive located adjacent said lateral edges of said respective interior-facing surfaces and generally adjacent said free edges thereof and creates a planar flange subpanel which contains said central passageway.

5. An item according to claim 1 wherein said first and second panels are also connected to said cover panels in the vicinity of said hinge line to form a false backbone structure and wherein said trailing edge of said tongue means is adhesively engaged as a part of said false backbone.

6. An item according to claim 1 wherein said flat tongue means is of such a length that said leading edge thereof lies between said first and second panels when said cover panels are in closed condition and emerges through said passageway when said covers are pivoted to the open position and said first and second panels create the three-dimensional configuration.

7. An item according to claim 1 wherein said free edge of at least one of said first and second panels has a curving configuration.

8. A blank for forming an item according to claim 1 wherein said cover panels are formed from an integral sheet with said straight hinge line being a first fold-line in said sheet, wherein said first and second panels are formed from sheet material which is folded about a second fold-line that is juxtaposed with said first fold-line, and wherein said tongue means includes tab means in the vicinity of said trailing edge which is adhesively attached to either said first panel or said second panel.

9. A blank for forming an item according to claim 1 wherein said covers are formed from integral sheet material with said straight hinge line being a fold-line in said sheet material and wherein said tongue means and said first panel are also formed from said same sheet material with said tongue means being hinged along a common line to said first panel in the blank.

10. A pop-up item which comprises a flattened assembly of at least one cover panel and first and second panels, each of said first and second panels having a free edge, an edge generally opposite said free edge, a pair of lateral edges, a line of weakness extending between said lateral edges which is generally parallel to said opposite edge of said first panel, and interior- and exterior-facing surfaces, each said line of weakness in said first and second panels dividing said panel into a facade subpanel and a base subpanel, a flat tongue panel having a leading edge and a trailing edge which is disposed between said interior surfaces of said first and second panels, means interconnecting said first and second panels in surface-to-surface contact with each other at locations on interior-facing surfaces thereof so as to form two planar regions which flank said leading edge portion of said tongue panel and create a planar flange region containing a central passageway in which said leading edge portion resides in said flattened assembly, said base subpanel of said first panel having its exterior-facing surface adhesively affixed to said cover panel, said base subpanel of said second panel being adapted for affixation to a support surface or to the interior surface of a second cover panel, and said tongue panel having such a length that, when said cover panel is pivoted away from such a surface to which said base subpanel of said second panel is affixed, said interconnected facade subpanels of first and second panels move toward said opposite edges, causing said tongue panel leading edge to protrude beyond said free edges of said first and second panels in attention-attracting orientation.

11. An item according to claim 10 wherein said leading edge of said tongue panel is a curving edge, which edge has the same contour as the free edge of at least one of said first and second panels and is obscured thereby in the flattened configuration.

12. An item according to claim 10 wherein said cover panel is hinged along a fold-line to said opposite edge of said second panel and wherein said first panel is hinged to said tongue panel along said trailing edge thereof.

13. An item according to claim 10 wherein said means interconnecting said first and second panels comprises adhesive located adjacent said lateral edges of said free edges of said respective interior-facing surfaces of said facade subpanel portions.

14. An item according to claim 10 wherein said interior-facing surfaces of said first and second panels are interconnected by first and second tab means formed in said tongue panel and respectively affixed thereto.

15. An item according to claim 10 which includes two of said cover panels that are hinged together along a straight hinge line, wherein said base subpanels of said first and second panels are located near said opposite edges thereof and wherein the exterior surfaces of said base subpanels are adhesively joined to said cover panels at locations adjacent said straight hinge line.

16. A pop-up item designed for mass production which comprises a pair of cover panels, first and second panels and a tongue panel, each of said five just-mentioned panels having a backbone subpanel, which backbone subpanels are adhesively interconnected to one another to create a false backbone, said pair of cover panels being hinged along said false backbone so as to permit pivoting to an open configuration, said cover panels each having an interior surface and an exterior surface, said first and second panels being disposed interior of said cover panels and sandwiched therebetween, each of said first and second panels having a free edge, an edge opposite said free edge where said backbone subpanel is located, a pair of lateral edges, and interior- and exterior-facing surfaces, adhesive means connecting regions of said interior-facing surface of said first panel in surface-to-surface contact with said interior-facing surface of said second panel at spaced apart locations generally adjacent said free edge and said lateral edges so as to create a planar flange which contains a central passageway in the region between said spaced-apart adhesive connections, said flat tongue means having a leading edge and a trailing edge and being disposed in said central passageway between said first and second panels, and means adhesively connecting sections of said interior surfaces of said cover panels respectively to sections of said exterior-facing surfaces of said first and second panels, said tongue means having such a length that, when said cover panels pivot away from each other about said false backbone, a three-dimensional configuration is created wherein said planar flange region of said first and second panels moves toward said hinge line, sliding relative to said tongue means, so that said leading edge thereof protrudes beyond said free edges of said first and second panels in attention-attracting orientation.

17. An item according to claim 16 wherein said first and second panels include base subpanels formed adjacent said backbone subpanels thereof, said exterior surfaces of which base subpanels are adhesively joined to said cover panels.

18. An item according to claim 16 wherein said flat tongue means is of such a length that said leading edge thereof lies hidden between said first and second panels when said cover panels are in closed condition and emerges through said passageway when said covers are pivoted to the open position so that said first and second panels create said three-dimensional configuration.

19. A blank for forming an item according to claim 16 wherein said cover panels and said first and second panels are formed from an integral sheet with said backbone subpanels of said cover panels and of said first and second panels all being located along one edge of said sheet.

20. A blank according to claim 19 wherein said first and second panels are located in flanking relationship to said pair of cover panels which are side-by-side centrally of said sheet, and wherein said first and second panels are disposed to be folded about fold-lines that are perpendicular to said one edge of said sheet so as to become respectively superimposed upon one of said cover panels.

* * * * *